US006234614B1

(12) United States Patent
Tomlin

(10) Patent No.: US 6,234,614 B1
(45) Date of Patent: May 22, 2001

(54) CONTINUOUS INKJET PRINTER

(75) Inventor: Matthew Tomlin, Cambridge (GB)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 09/331,541

(22) PCT Filed: Dec. 18, 1997

(86) PCT No.: PCT/GB97/03496

§ 371 Date: Aug. 16, 1999

§ 102(e) Date: Aug. 16, 1999

(87) PCT Pub. No.: WO98/28153

PCT Pub. Date: Jul. 2, 1998

(30) Foreign Application Priority Data

Dec. 23, 1996 (GB) ..... 9626684

(51) Int. Cl.[7] ..... B41J 2/025; B41J 2/17
(52) U.S. Cl. ..... 347/75; 347/94
(58) Field of Search ..... 347/73, 74, 75, 347/94, 42, 49

(56) References Cited

U.S. PATENT DOCUMENTS 4,800,398 * 1/1989 Naruse et al. ..... 347/75
4,985,715 * 1/1991 Cyphert et al. ..... 347/75
5,757,404 * 5/1998 Witteveen et al. ..... 347/71

FOREIGN PATENT DOCUMENTS 62-294554 * 12/1987 (JP) ..... 347/94

* cited by examiner

*Primary Examiner*—David F. Yockey
(74) *Attorney, Agent, or Firm*—Robert F.I. Conte; Lee, Mann, Smith, McWilliams, Sweeney & Ohlson

(57) ABSTRACT

A CIJ printer has a drop generator and a mount. The mounting of the drop generator on the mount is by a pair of fixing screws locating in countersunk screw-threaded bores in the drop generator and disposed in the resilient bushings located in corresponding bores in the mount. To reduce the transfer of ultrasonic vibrations and mounting stresses imposed on the drop generator, two pairs of point contacts protrude between the mount and the drop generator. Each pair being in alignment with the centre of a respective one of the fixing screws and on respective lines perpendicular to a line connecting the centers of the fixing screws.

4 Claims, 2 Drawing Sheets

CONTINUOUS INKJET PRINTER

FIELD THE INVENTION

The present invention relates to continuous inkjet (CIJ) printers and, more particularly, to CIJ printers of the multi-nozzle type.

BACKGROUND OF THE INVENTION

Multi-nozzle continuous inkjet printers have been developed in order to provide high quality, high speed printing. A row of inkjet nozzles at very close spacings are provided and individual streams of ink issue from each of the nozzles continuously in use, being broken up into individual droplets automatically. The individual droplets are charged appropriately to cause them to be printed or else deflected into a gutter. Printers of this type are described, for example, in U.S. Pat. No. 4,613,871 and U.S. Pat. No. 4,427,986. The printers described in these specifications are of the type generally known as binary continuous multi-jet.

The drop generator of such a printer has one or more ultrasonic transducers, usually piezoelectric transducers, which cause the streams of ink issuing from the nozzles to be broken up into droplets at a certain position below the nozzle. In order to avoid unnecessary movement of other components and avoid wasteful downtime in frequent re-adjustment of the positions of the components relative to one another, the vibrations caused by the operation of the ultrasonic transducers and transmitted into the rest of the printhead need to be reduced as much as possible. Additionally, if the drop generator is to work in accordance with its design parameters then it needs to be mounted in a manner such that is not distorted by stresses imposed by the mounting.

SUMMARY OF THE INVENTION

According to the present invention therefore a CIJ printer has a drop generator and a mount therefor, the mounting of the drop generator on the mount being achieved by means of a pair of fixing screws located in screw-threaded bores in the drop generator and disposed in resilient bushes located in corresponding bores in the mount, and two pairs of point contacts protruding between the mount and the drop generator, each pair being in alignment with the centre of a respective one of the fixing screws and on a line perpendicular to a line connecting the centres of the fixing screws.

By this means, the transfer of ultrasonic vibrations is reduced significantly and mounting stresses imposed on the drop generator are likewise reduced to a minimum.

The invention also includes a printer having such a printhead.

One example of a printhead incorporating the present invention will now be described with reference to the accompanying drawings in which:

DETAILED DESCRIPTION OF THE INVENTION

Figure 1:
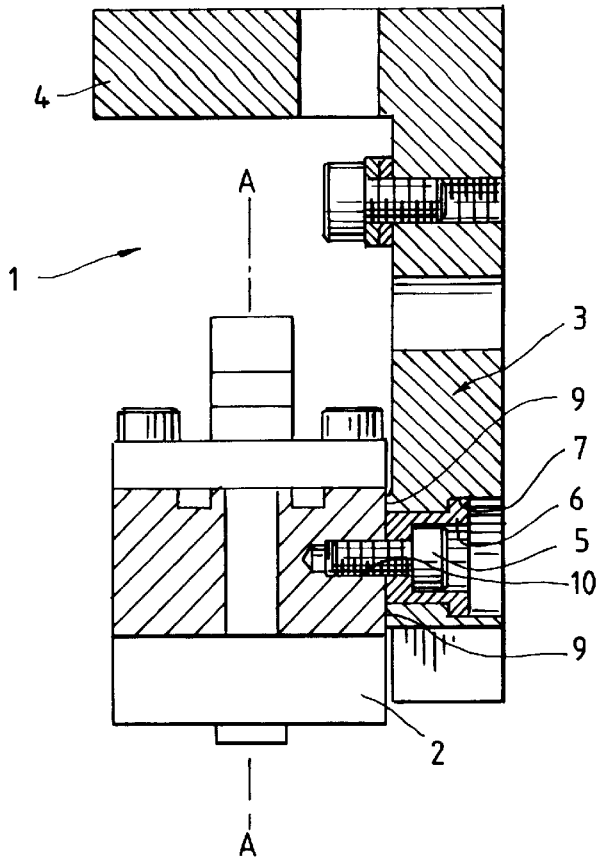
FIG. 1 is a side cross-sectional elevation of part of the printhead.
Figure 2:
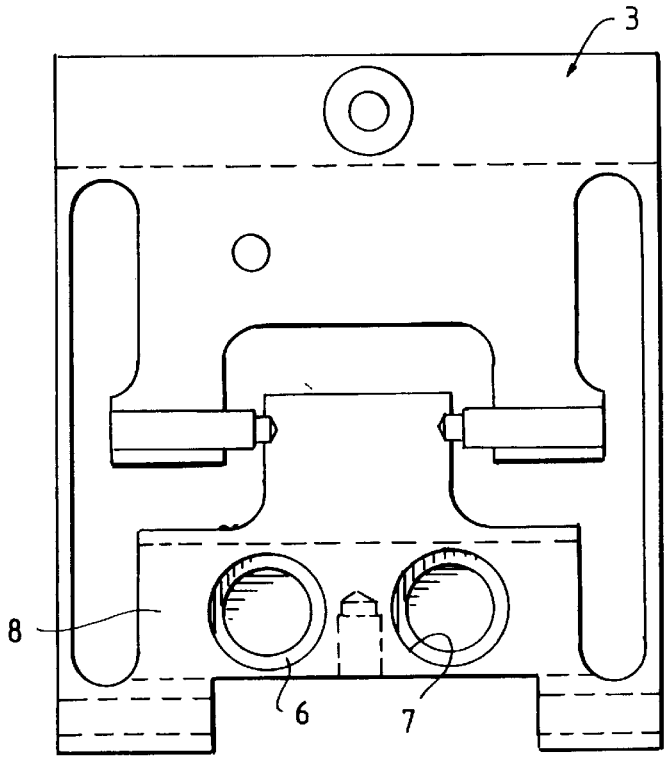
FIG. 2 is a further side elevation at 90° to the first, just showing the mounting plate used to mount the drop generator in the printhead.
Figure 3:
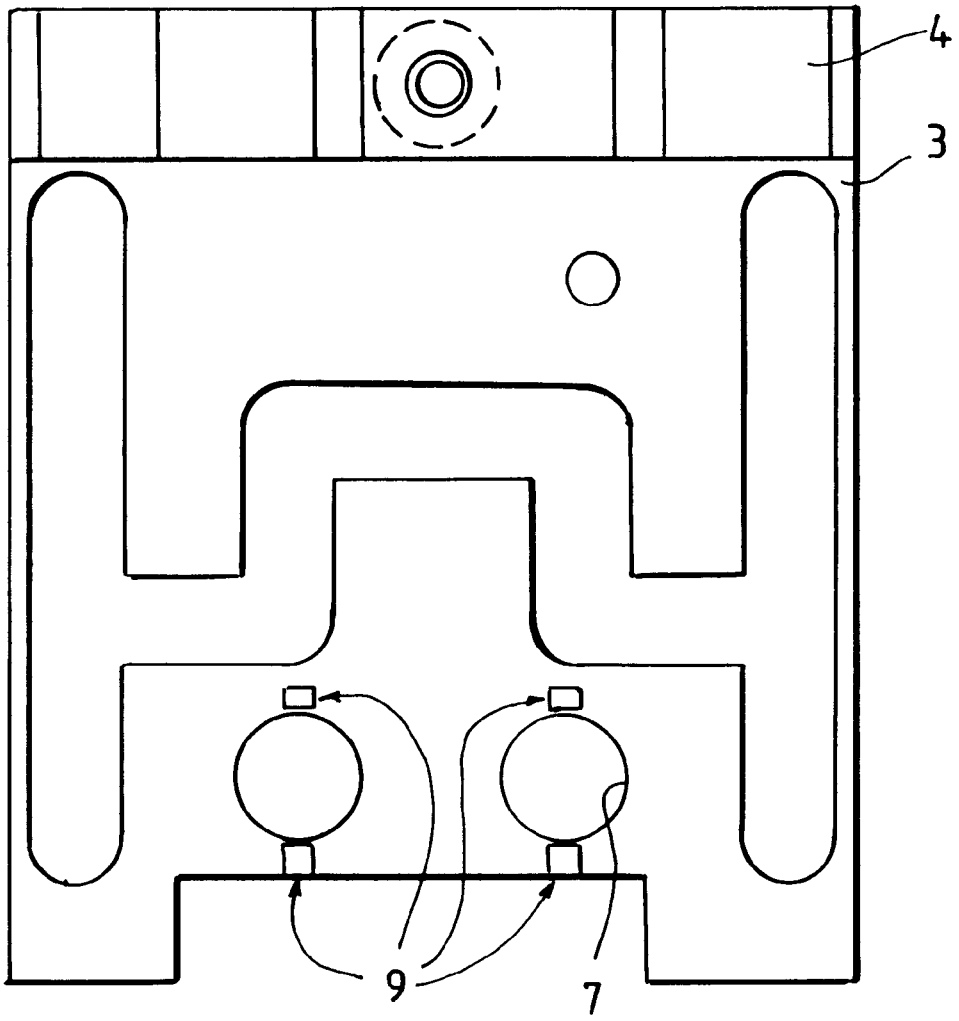
FIG. 3 is a side elevation of the mounting plate from the other side.

The drawings show part of a printhead 1 with a drop generator 2 secured to a mount in the form of a flexure 3 which is in turn secured to a support 4, the mount or flexure 3 is preferably as described in our British Patent Application no. 9626683.8 and our co-pending International Patent application reference MJB05545WO and the method by which the mounting plate 3 is secured to the plate 4 is preferably as described in our British Patent Application no. 9626704.2 and our co-pending International Patent application reference MJB05497WO.

In order to mount the drop generator on the flexure 3 a pair of screws 5 are positioned through respective resilient plastics bushings 6 located in stepped bores 7 in the lower mounting portion 8 of the flexure 3 and two pairs of point contacts 9, formed as protrusions from the body of the mount, are positioned in alignment with the centre of the screws 5, spacing the droplet generator from the adjacent face of the flexure 3. The pairs of point contacts, together with the resilient bushes 6 reduce transmission of ultrasonic vibrations to a minimum and, each pair being aligned on respective lines perpendicular to a line connecting the centres of the fixing screws, provide a mounting which avoids stressing the drop generator 2 in the longitudinal bending mode by ensuring that the contacts 9 and fixing screws 5 are aligned perpendicular to the length of the drop generator, ie the axis along which droplets are produced in use (shown as A—A in FIG. 1).

What is claimed is:

1. A CIJ printhead comprising:

a drop generator, the drop generator having a pair of screw-threaded bores; a mount for the printhead, the mount having a pair of countersunk bores and a corresponding pair of resilient bushings located in the corresponding bores in the mount; a pair of fixing screws disposed in the resilient bushings of the mount and located in the screw-threaded bores of the drop generator; and two pairs of point contacts protruding between the mount and the drop generator, each pair being in alignment with the center of a respective one of the fixing screws and on a line perpendicular to a line connecting the centers of the fixing screws.

2. A printhead according to claim 1, wherein the point contacts comprise protrusions from the mount.

3. A CIJ printer having a printhead comprising:

a drop generator, the drop generator having a pair of screw-threaded bores, a mount for the printhead, the mount having a pair of countersunk bores and a corresponding pair of resilient bushings located in the corresponding bores in the mount;

a pair of fixing screws disposed in the resilient bushings of the mount and located in the screw-threaded bores of the drop generator; and two pairs of point contacts protruding between the mount and the drop generator, each pair being in alignment with the center of a respective one of the fixing screws and on a line perpendicular to a line connecting the centers of the fixing screws.

4. The CIJ printer of claim 3, wherein the point contacts comprise protrusions extending from the mount.

* * * * *